US012108874B2

(12) United States Patent
Tabujara et al.

(10) Patent No.: US 12,108,874 B2
(45) Date of Patent: Oct. 8, 2024

(54) MODULAR SHELF

(71) Applicant: Whitmor, Inc., Southaven, MS (US)

(72) Inventors: James Tabujara, Memphis, TN (US); Sandy Felsenthal, Memphis, TN (US)

(73) Assignee: Whitmor, Inc., Southaven, MS (US)

( * ) Notice: Subject to any disclaimer, the term of this patent is extended or adjusted under 35 U.S.C. 154(b) by 140 days.

(21) Appl. No.: 17/890,183

(22) Filed: Aug. 17, 2022

(65) Prior Publication Data

US 2022/0386772 A1 Dec. 8, 2022

Related U.S. Application Data

(63) Continuation-in-part of application No. 17/669,285, filed on Feb. 10, 2022, now abandoned.

(60) Provisional application No. 63/148,029, filed on Feb. 10, 2021.

(51) Int. Cl.

| | |
|---|---|
| ***A47B 47/00*** | (2006.01) |
| ***A47B 3/08*** | (2006.01) |
| ***A47B 87/02*** | (2006.01) |

(52) U.S. Cl.

CPC ..... *A47B 47/0091* (2013.01); *A47B 3/08* (2013.01); *A47B 87/0207* (2013.01)

(58) Field of Classification Search

CPC ... A47B 47/047; A47B 47/0091; A47B 87/02; A47B 87/002; A47B 87/0215; A47B 87/0207; A47B 3/08; A47B 23/001

See application file for complete search history.

(56) References Cited

U.S. PATENT DOCUMENTS

| | | | | |
|---|---|---|---|---|
| 2,888,305 | A * | 5/1959 | Perry | A47B 1/08 108/65 |
| 4,383,488 | A * | 5/1983 | Macho | A47B 3/0812 108/130 |
| 7,086,500 | B2 * | 8/2006 | Moss | E06C 7/16 182/119 |
| 9,888,769 | B1 * | 2/2018 | Mroue | F16B 1/00 |
| 10,012,000 | B2 * | 7/2018 | Yoo | E04G 5/16 |
| 10,092,099 | B1 * | 10/2018 | Linari | A47B 61/04 |
| 10,556,720 | B2 * | 2/2020 | Kauffman | B65D 19/385 |
| 10,858,848 | B2 * | 12/2020 | Woodward | E04G 1/30 |
| 11,278,115 | B1 * | 3/2022 | Chen | A47B 47/024 |
| 11,832,718 | B2 * | 12/2023 | Foley | A47B 1/10 |
| 2013/0055930 | A1 * | 3/2013 | Peery | A47B 3/002 108/91 |

(Continued)

*Primary Examiner* — Daniel J Rohrhoff
(74) *Attorney, Agent, or Firm* — Stites & Harbison PLLC; Richard S. Myers, Jr.; Patrick M. Torre

(57) ABSTRACT

A shelf or storage rack includes a top defined by a pair of elongated members held at a spaced distance from one another by a pair of frame end members and at least two frame cross-members respectively disposed at a spaced distance from each of the pair of frame end members to define a plurality of spaced slots. A left side support and a right side support are each defined by elongated support members held by at least one support cross-member, wherein at least a portion of the elongated support members has a first end including a protrusion and an adjoining support ledge and an opposed second end including a notch or groove. The protrusions and notches or grooves interact to provide a vertically stackable modular shelf or storage rack system.

17 Claims, 6 Drawing Sheets

(56) References Cited

U.S. PATENT DOCUMENTS

| | | | | |
|---|---|---|---|---|
| 2018/0085912 | A1* | 3/2018 | Cindric | E06C 1/39 |
| 2022/0118567 | A1* | 4/2022 | Darling | A47B 1/05 |

* cited by examiner 20
23
24
25
26
27
28
30
31
32
33
34
40
42
43
44

MODULAR SHELF

RELATED APPLICATIONS

This utility patent application is a continuation-in-part of U.S. patent application Ser. No. 17/669,285 filed on Feb. 10, 2022 which in turn claims priority to U.S. Provisional Patent Application Ser. No. 63/148,029 filed Feb. 10, 2021, the entirety of the disclosures of each of which is incorporated herein by reference.

TECHNICAL FIELD

The present invention relates to a modular shelf or rack that is easily assembled and customizable, and which may include multiple conveniently vertically stackable units.

BACKGROUND

It is known to provide shelving including multiple stackable units. While effective for their intended purpose, conventional stackable shelving units often require tools and/or fasteners for assembly. They are therefore inconvenient to assemble and disassemble. The present disclosure solves this problem by providing sturdy, stable modular shelving including units that can be easily assembled or disassembled without use of tools or any requirement for fasteners.

SUMMARY

In one aspect of the disclosure, a shelf or storage rack is provided having a top comprising a frame defined by a pair of elongated frame side members held at a spaced distance from one another by a pair of frame end members, a plurality of elongated top members each disposed in an interior of the frame at a spaced distance from one another, and at least two frame cross-members respectively disposed at a spaced distance from each of the pair of frame end members to define a plurality of spaced slots.

Supports for the top comprise a left side support and a right side support each comprising a plurality of elongated support members held at a spaced distance from one another by at least one support cross-member, wherein at least a portion of the plurality of elongated support members has a first end including a protrusion and an adjoining support ledge. In embodiments at least a portion of the plurality of elongated support members has an opposed second end including a notch or groove.

In embodiments, the elongated frame side members and elongated top members may be arranged in a substantially parallel orientation to one another and may have a same or a different dimension from one another.

Each of the protrusions is dimensioned and positioned to be received in a cooperating slot of the plurality of spaced slots. Each of the protrusions is further dimensioned whereby, when received in the cooperating slot, at least a portion of the protrusion extends above a top plane of the cooperating slot. Each of the notches or grooves are dimensioned and positioned to be nested atop the at least a portion of the protrusion extending above the top plane.

In another aspect of the disclosure, a shelf or storage rack assembly is provided comprising at least two cooperating vertically stackable shelf units as described above. As described, each of the protrusions of the elongated support members is dimensioned and positioned to be received in a cooperating slot of the plurality of spaced slots of the top.

When so received in the cooperating slot, at least a portion of the protrusion extends above a top plane of the cooperating slot.

In embodiments, each of the notches or grooves of the elongated support members are dimensioned and positioned to be nested atop the at least the portion of the protrusion of a extending above the top plane of the cooperating slot. In embodiments, when so nested a bottom surface portion of the elongated support member adjacent to the notch or groove rests atop a top surface portion of a vertically adjacent shelf or storage rack top.

These and other objects of the present invention will become readily apparent while reviewing the preferred embodiments and examples of the present invention disclosed herein in the description of the invention below and the accompanying drawings. All publications, patents, and patent applications mentioned in this specification, if any, are herein incorporated by reference to the same extent as if each individual publication, patent, or patent application was specifically and individually indicated to be incorporated by reference.

BRIEF DESCRIPTION OF THE DRAWINGS

The novel features of the disclosure are set forth with particularity in the appended claims. A better understanding of the features and advantages of the present invention will be obtained by reference to the following detailed description that sets forth illustrative embodiments, in which the principles of the invention are used, and the accompanying drawings of which:

Figure 1:
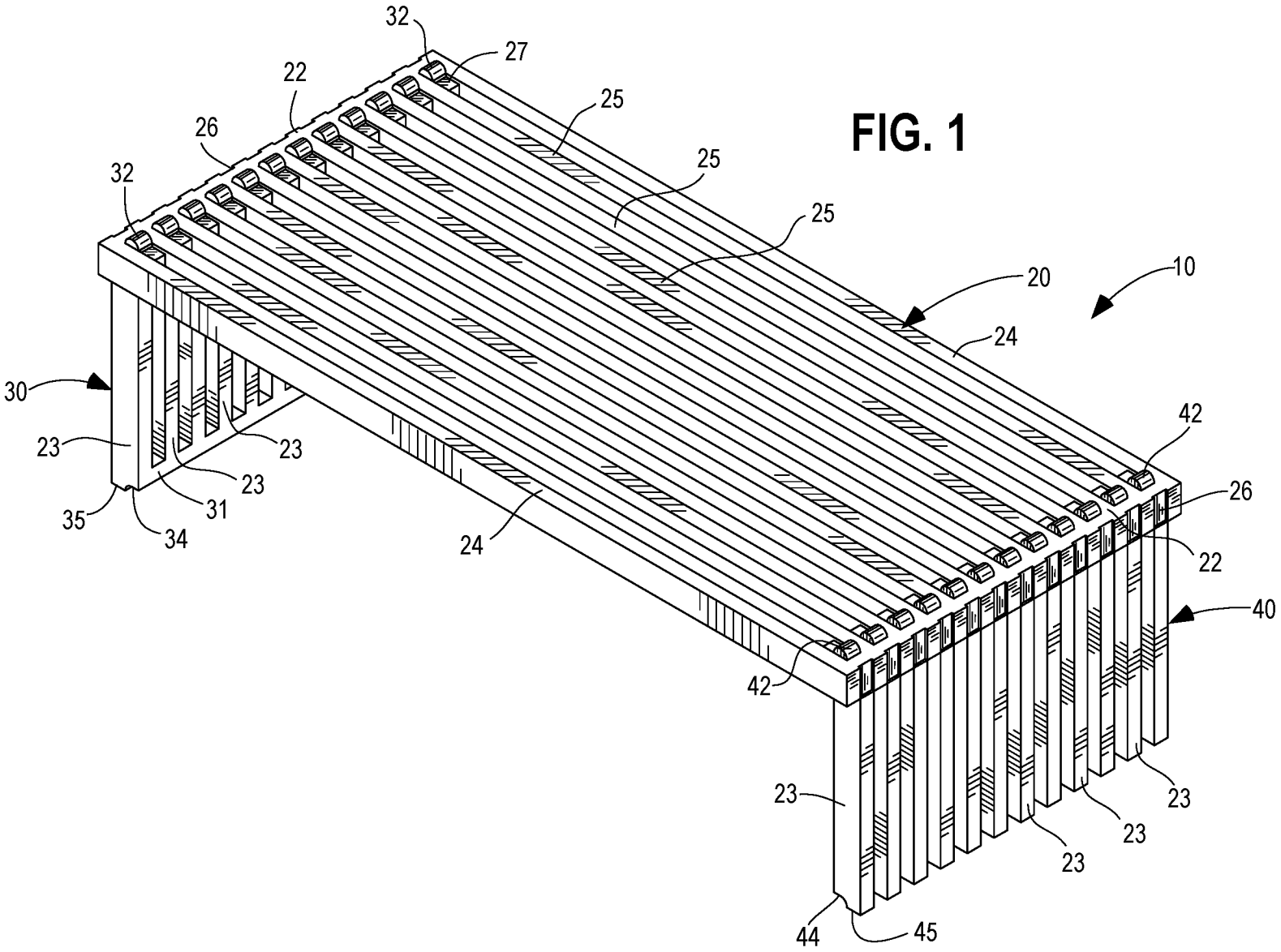
FIG. 1 is a front perspective view of a modular shelf according to the present disclosure.

While the disclosure is susceptible to various modifications and alternative forms, specific embodiments thereof have been shown by way of example in the drawings and are herein described below in detail. It should be understood, however, that the description of specific embodiments is not intended to limit the disclosure to cover all modifications, equivalents and alternatives falling within the spirit and scope of the disclosure as defined by the appended claims. For purposes of clarity in illustrating the characteristics of the present invention, proportional relationships of the elements have not necessarily been maintained in the drawing figures.

DETAILED DESCRIPTION

The following description of the invention references specific embodiments in which the invention can be practiced. The embodiments are intended to describe aspects of the invention in sufficient detail to enable those skilled in the art to practice the invention. Other embodiments can be utilized and changes can be made without departing from the scope of the present invention. The present invention is defined by the appended claims and the description is, therefore, not to be taken in a limiting sense and shall not limit the scope of equivalents to which such claims are entitled.

As stated above, the present invention relates to a modular shelf or rack that is easily assembled and customizable. One embodiment of the present invention is a modular shelving unit or rack that can be easily assembled and disassembled without the necessity of tools. The shelving unit can have multiple shelves.

FIG. 1 shows an embodiment of the present invention where the unit 10 provides one shelf. The unit 10 is formed of a top 20, a left side support 30, and a right side support 40 which as will be described may be conveniently assembled and disassembled without any requirement for tools.

Figure 2:
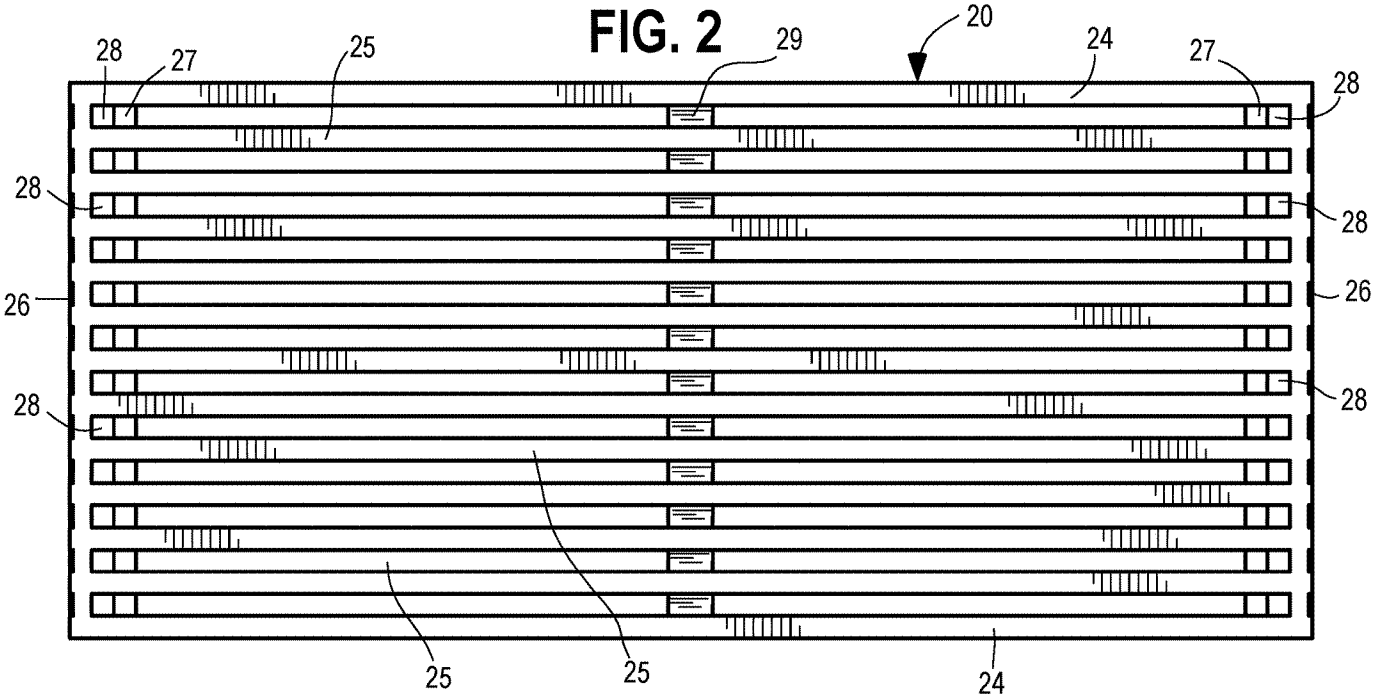
FIG. 2 is a top view of the modular shelf of FIG. 1.

As shown in FIG. 2, the top 20 is defined by a frame formed of opposed elongated side frame members 24 held at a spaced distance from one another by a pair of frame end members 26. A plurality of elongated top frame members 25 are disposed in an interior of the frame at a spaced distance from one another. At least two frame cross-members 27 are respectively disposed at a spaced distance from each of the elongated side frame members 24 whereby a plurality of spaced slots 28 are defined. Optionally, additional frame cross-members 29 may be provided as needed for structural strength and stability of the top 20, in accordance with a length of the elongated frame side members 24 and elongated top members 25. The elongated side frame members 24, top frame member 25, frame end members 26, and frame cross-members 27 and/or 29 may have any desired length, width, depth, or cross-sectional dimension or shape according to the desired functionality and/or aesthetic.

Figures 4, 5:
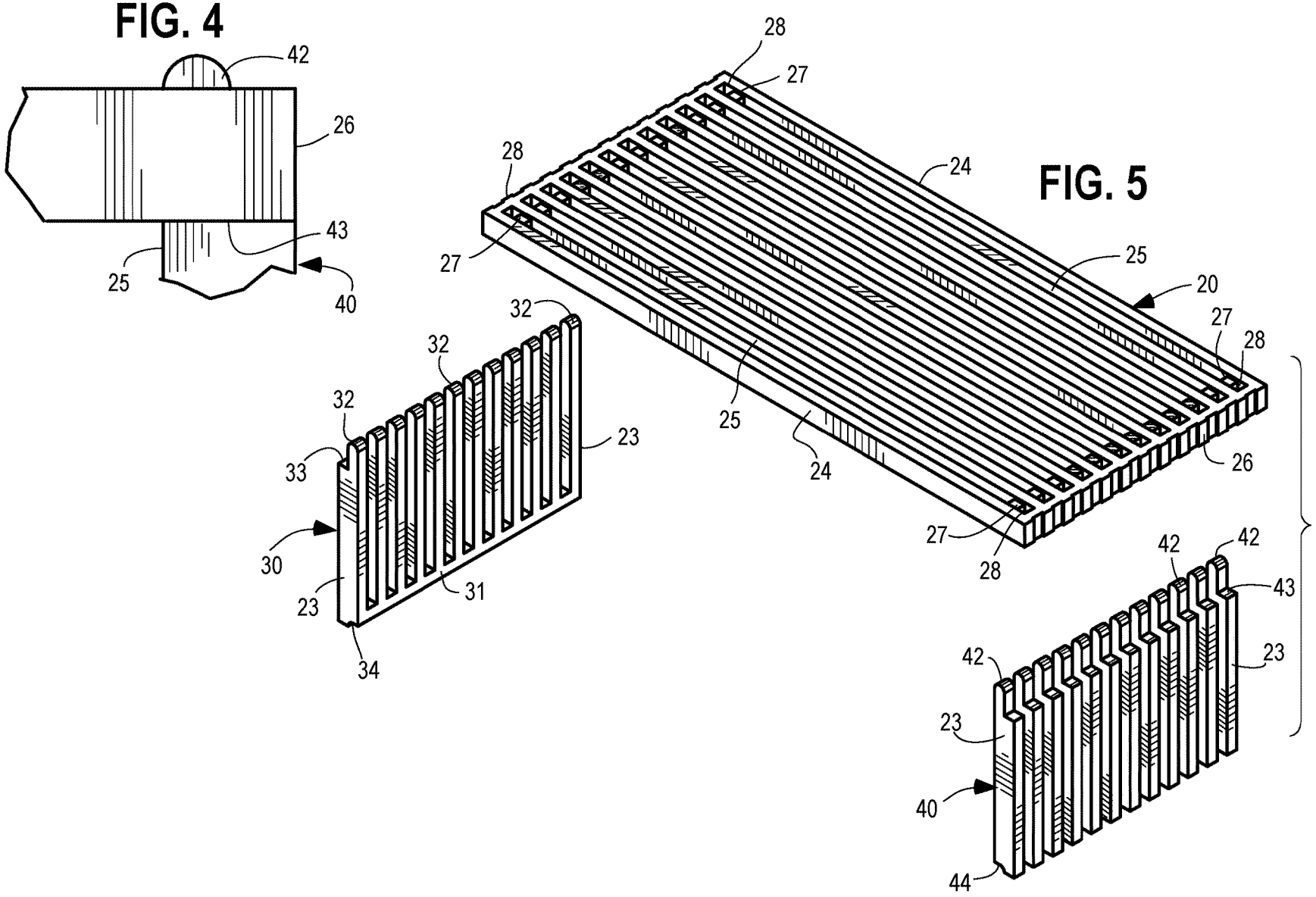
FIG. 4 is an isolated view of the interaction between the top and side support of the modular shelf of FIG. 1.
FIG. 5 is an exploded view of the modular shelf of FIG. 1.

The side supports 30, 40 (see also FIG. 3) are each defined by a plurality of elongated support members 23 held at a spaced distance from one another by at least one support cross-member 31. The elongated support members 23 may have the same dimensions as the elongated top frame members 25, or may have different dimensions therefrom. With reference also to FIG. 5, at least a portion of the elongated support members 23 of side supports 30, 40 have a first end including a protrusion 32, 42 and an adjoining support ledge 33, 43. At least a portion of the elongated support members 23 of side supports 30, 40 also have a second end including a notch or groove 34, 44, the purpose of which will be described infra. The elongated support members 23 and support cross-members 31 may have any desired length, width, depth, or cross-sectional dimension or shape according to the desired functionality and/or aesthetic.

Figure 3:
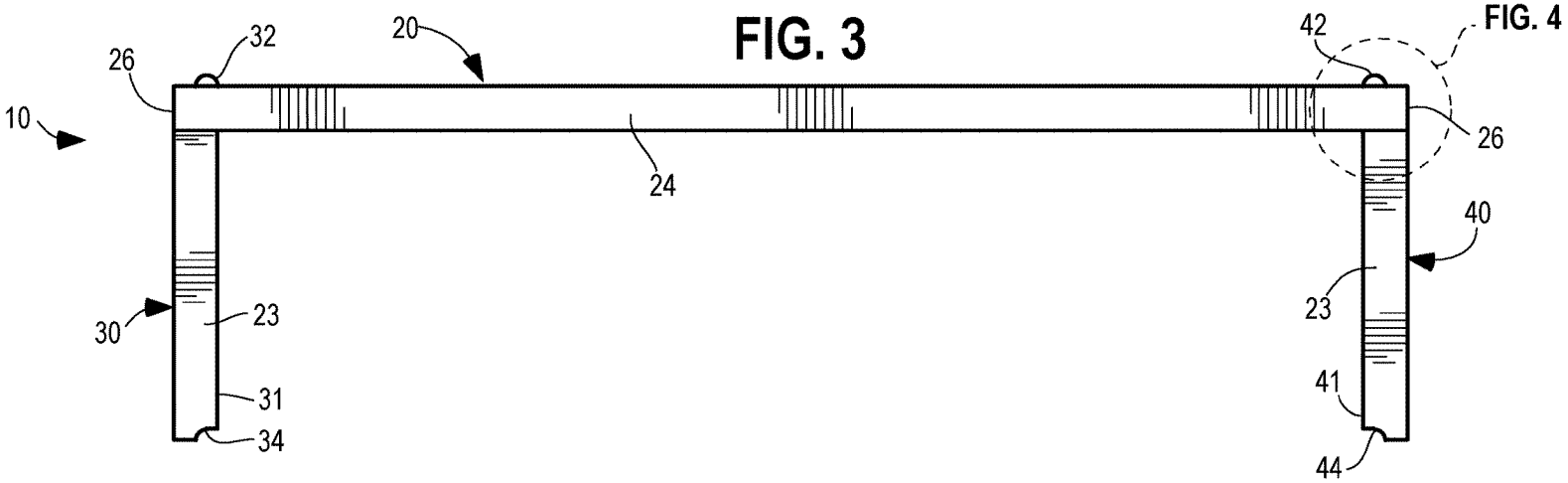
FIG. 3 is a front view of the modular shelf of FIG. 1.
Figure 6:
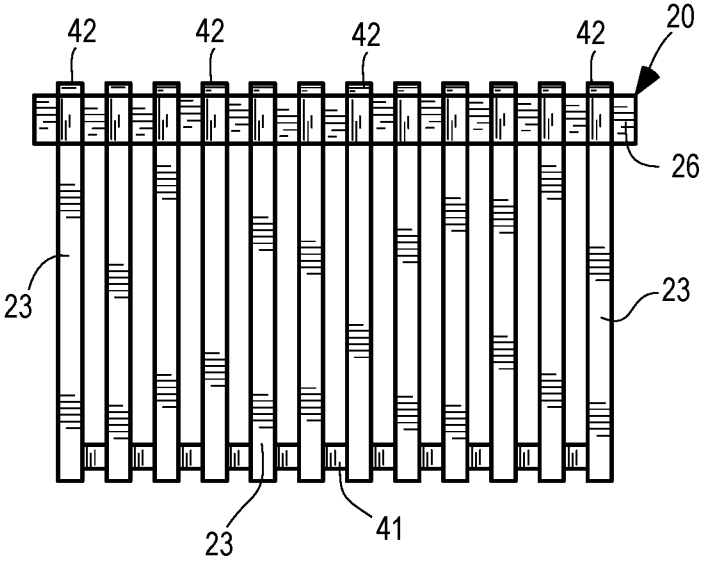
FIG. 6 is a right side view of the modular shelf of FIG. 1, with the left side view being a substantial duplicate.

As shown in FIG. 3 and in isolation in FIG. 4, each of the protrusions 32, 42 are dimensioned and positioned to be received in and pass through a cooperating slot 28 of the plurality of slots 28 such that a portion of each protrusion 32, 42 extends above a top plane of top 20. As will appreciated, a portion of a bottom surface of top 20 and/or of cross-members 27 rests on a top surface of support ledges 33, 43. As shown especially in FIGS. 3 and 6, the interaction between the cooperating protrusions 32, 42, slots 28, and support ledges 33, 43 dispose top 20 and supports 30, 40 at a substantially perpendicular orientation to one another, thus providing improved stability to the assembled unit 10 without requiring tools or fasteners to secure top 20 to side supports 30, 40. Equally, each unit 10 can be easily disassembled without requiring tools or removal of fasteners.

The skilled artisan will appreciate that each of the elements of top 20 and left and right side supports 30, 40 may be provided as unitary elements, may be provided as the individual described components fastened one to another by suitable fasteners (nails, screws, bolts, adhesives, dowels, or the like) or by interlocking or snap-fit features, or may be a combination thereof. For example, the described frame of top 20 could be a unitary element and the individual elongated top members 25 could be individual elements fastened thereto. Equally, it will be appreciated that the unit 10 could be fabricated of any suitable materials or combination of materials, for example wood, molded plastics or other polymers, metal, and the like.

Figure 7:
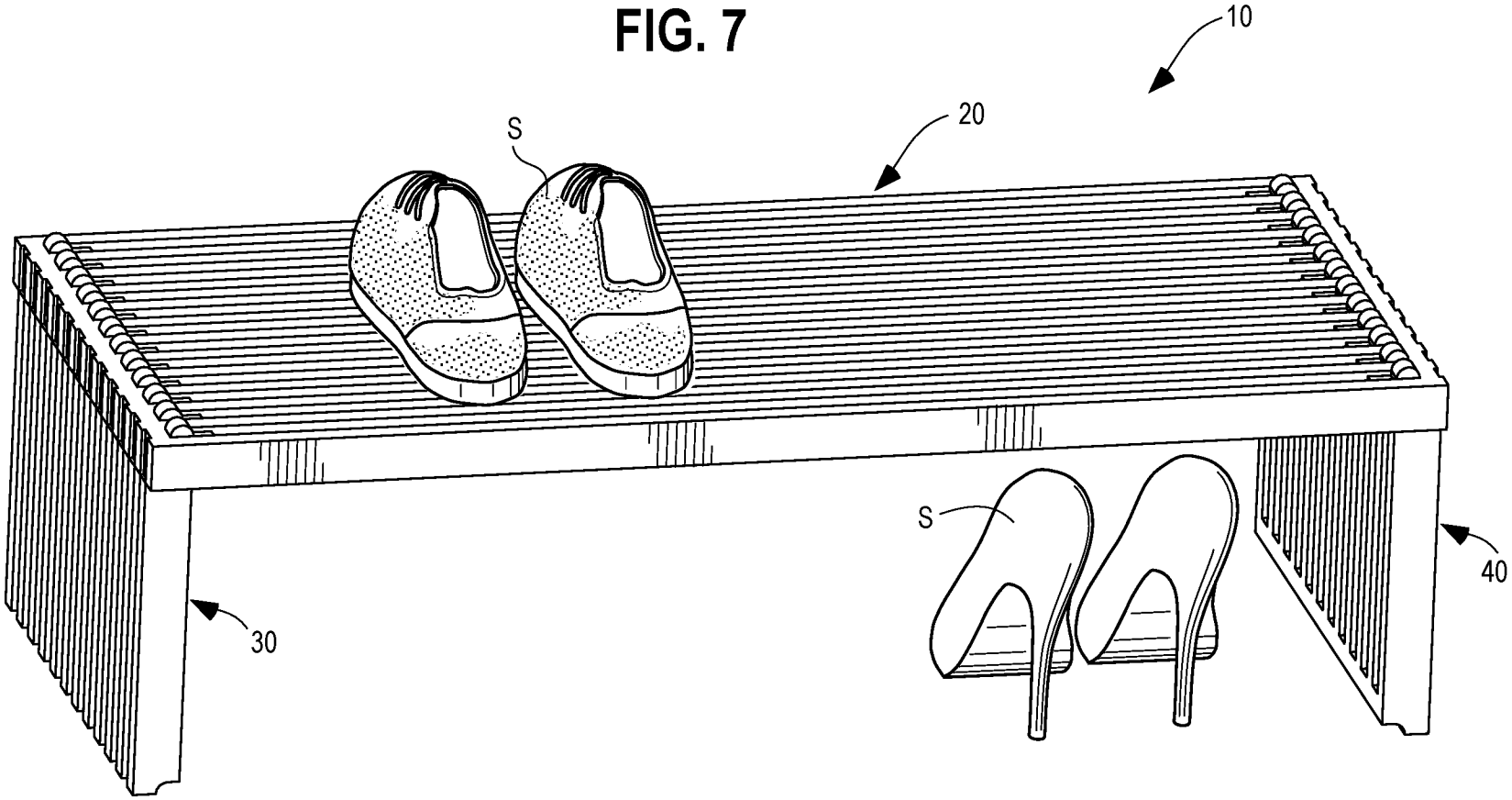
FIG. 7 illustrates the modular shelf of FIG. 1 in use as a shoe rack.
Figure 8:
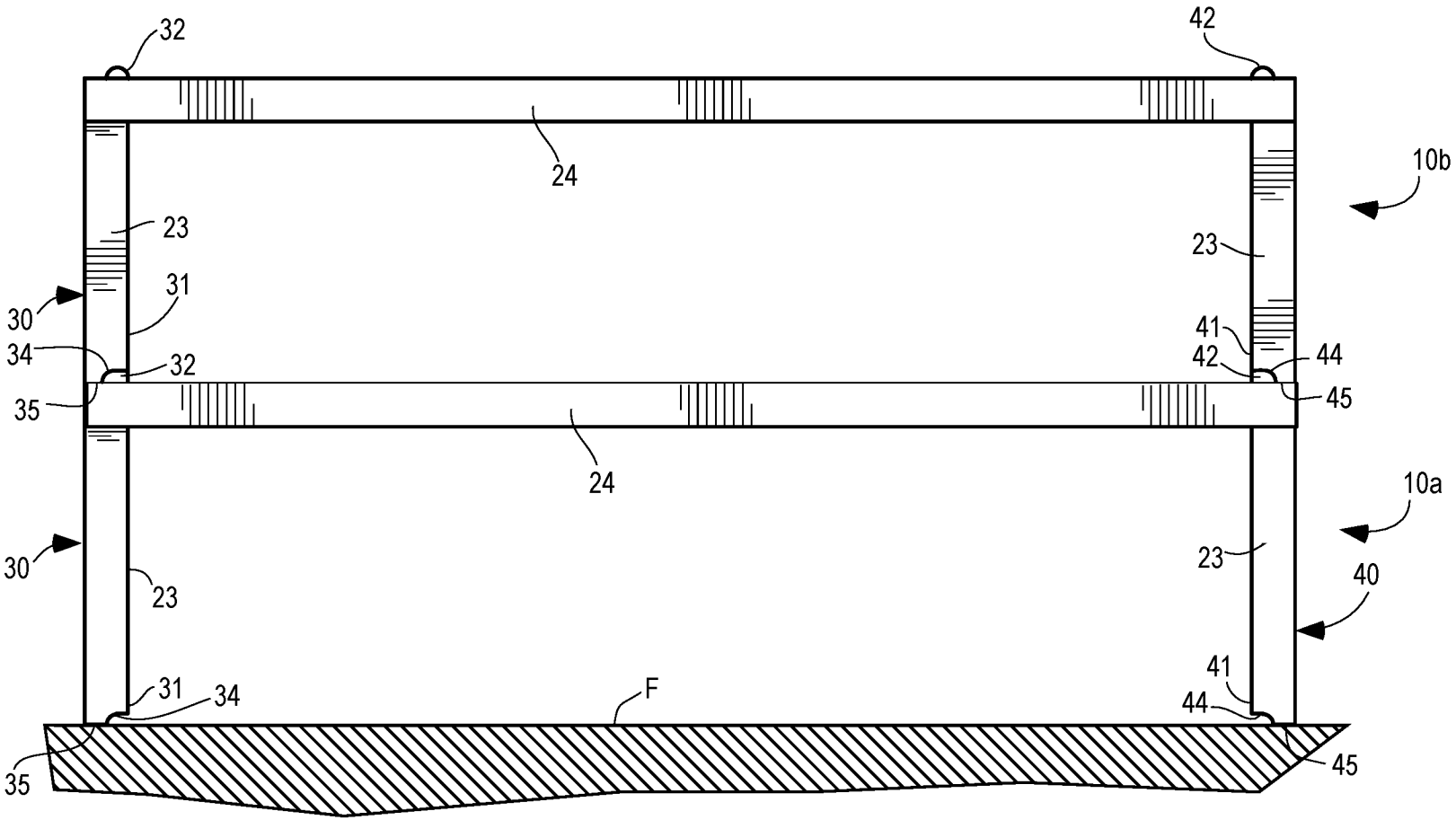
FIG. 8 illustrates the stackable feature of the modular shelf of FIG. 1.

As shown in FIG. 7, in an embodiment the assembled units 10 may be provided as a single shelf for a variety of uses, for example a rack for storing shoes S. In an alternative embodiment, the units 10 may be stacked one above the other to form a multi-shelf unit for storing any desired item such as shoes, articles of clothing, etc. FIG. 8 depicts a two-shelf modular system including a first unit 10*a* and a second unit 10*b*. As shown, the first unit 10*a* is placed on a surface such as a floor F or table top (not shown). Next, the second unit 10*b* is stacked vertically above first unit 10*a*. Notches or grooves 34, 44 of the elongated support members 23 of second unit 10*b* nest over the respective cooperating protrusions 32, 42 of the elongated support members 23 of vertically adjacent first unit 10*a*. A bottom surface portion 35, 45 of each elongated support member 23 concurrently rests on a top surface portion 22 of each end member 26 of top 20, defining a linear segmented side support for the modular system that transmits the load of each unit 10 vertically through each support member 30, 40.

As will be appreciated this provides a much more sturdy and stable stacking feature, again without requiring use of tools or fasteners to join vertically stacked units 10*a*, 10*b* together. Embodiments can therefore include 2, 3, 4, and even more vertically stacked units to provide any desired number of vertically disposed shelves which can easily be assembled and disassembled without use of tools or fasteners. By the described features and embodiments, an attractive, sturdy, and stable modular shelf unit is provided.

From the foregoing, it will be seen that this invention is one well adapted to attain all the ends and objects hereinabove set forth together with other advantages which are obvious and which are inherent to the structure. It will be understood that certain features and sub combinations are of utility and may be employed without reference to other features and sub combinations. This is contemplated by and is within the scope of the claims. Since many possible embodiments of the invention may be made without departing from the scope thereof, it is also to be understood that all matters herein set forth or shown in the accompanying drawings are to be interpreted as illustrative and not limiting.

The constructions described above and illustrated in the drawings are presented by way of example only and are not intended to limit the concepts and principles of the present invention. Thus, there have been shown and described several embodiments of a novel invention.

Following long-standing patent law convention, the terms "a", "an", and "the" refer to "one or more" when used in this application, including the claims. As is evident from the foregoing description, certain aspects of the present invention are not limited by the particular details of the examples illustrated herein, and it is therefore contemplated that other modifications and applications, or equivalents thereof, will occur to those skilled in the art. The terms "having" and "including" and similar terms as used in the foregoing specification are used in the sense of "optional" or "may include" and not as "required." The present application can "comprise" (open ended) or "consist essentially of" the components of the present invention as well as other ingredients or elements described herein. As used herein, "comprising" is open ended and means the elements recited, or their equivalent in structure or function, plus any other element or elements which are not recited. The terms "having" and "including" are also to be construed as open ended unless the context suggests otherwise.

Many changes, modifications, variations and other uses and applications of the present construction will become apparent to those skilled in the art after considering the specification and the accompanying drawings. All such changes, modifications, variations and other uses and applications which do not depart from the spirit and scope of the invention are deemed to be covered by the invention which is limited only by the claims which follow.

What is claimed:

1. A shelf or storage rack, comprising:

a top comprising a frame defined by a pair of elongated frame side members held at a spaced distance from one another by a pair of frame end members, a plurality of elongated top members each disposed in an interior of the frame at a spaced distance from one another, and at least two frame cross-members respectively disposed at a spaced distance from each of the pair of frame end members to define a plurality of spaced slots; and a left side support and a right side support each comprising a plurality of elongated support members held at a spaced distance from one another by at least one support cross-member, wherein at least a portion of the plurality of elongated support members has a first end including a protrusion and an adjoining support ledge, further wherein each protrusion is dimensioned and positioned to be received in a cooperating slot of the plurality of spaced slots.

2. The shelf or storage rack of claim 1, wherein at least a portion of the plurality of elongated support members has an opposed second end including a notch or groove.

3. The shelf or storage rack of claim 1, wherein each of the protrusions is further dimensioned whereby, when received in the cooperating slot, at least a portion of the protrusion extends above a top plane of the top.

4. The shelf or storage rack of claim 3, wherein each of the notches or grooves are dimensioned and positioned to be nested atop the at least a portion of the protrusion extending above the top plane.

5. The shelf or storage rack of claim 1, wherein the elongated frame side members and elongated top members are arranged in a substantially parallel orientation to one another.

6. The shelf or storage rack of claim 1, wherein the elongated frame top members and support members have a same or a different dimension from one another.

7. A shelf or storage rack assembly, comprising:

at least two cooperating vertically stackable shelf units each comprising:

a top comprising a frame defined by a pair of elongated frame side members held at a spaced distance from one another by a pair of frame end members, a plurality of elongated top members each disposed in an interior of the frame at a spaced distance from one another, and at least two frame cross-members respectively disposed at a spaced distance from each of the pair of frame end members to define a plurality of spaced slots; and a left side support and a right side support each comprising a plurality of elongated support members held at a spaced distance from one another by at least one support cross-member, wherein at least a portion of the plurality of elongated support members has a first end including a protrusion and an adjoining support ledge and an opposed second end including a notch or groove.

8. The shelf or storage rack assembly of claim 7, wherein each of the protrusions is dimensioned and positioned to be received in a cooperating slot of the plurality of spaced slots.

9. The shelf or storage rack assembly of claim 8, wherein each of the protrusions is further dimensioned whereby, when received in the cooperating slot, at least a portion of the protrusion extends above a top plane of the top.

10. The shelf or storage rack assembly of claim 9, wherein each of the notches or grooves are dimensioned and positioned to be nested atop the at least the portion of the protrusion of a vertically adjacent elongated support member extending above the top plane of the cooperating slot.

11. The shelf or storage rack assembly of claim 10, wherein each of the notches or grooves are further dimensioned whereby, when nested atop the portion of the protrusion, a bottom surface portion of the elongated support member adjacent to the notch or groove rests atop a top surface portion of a vertically adjacent shelf or storage rack top.

12. The shelf or storage rack assembly of claim 7, wherein the elongated frame side members and elongated top members are arranged in a substantially parallel orientation to one another.

13. The shelf or storage rack assembly of claim 7, wherein the elongated frame top members and support members have a same or a different dimension from one another.

14. A shelf or storage rack assembly, comprising:

at least two cooperating vertically stackable shelf units each comprising:

a top comprising a frame defined by a pair of elongated frame side members held at a spaced distance from one another by a pair of frame end members, a plurality of elongated top members each disposed in an interior of the frame at a spaced distance from one another, and at least two frame cross-members respectively disposed at a spaced distance from each of the pair of frame end members to define a plurality of spaced slots; and a left side support and a right side support each comprising a plurality of elongated support members held at a spaced distance from one another by at least one support cross-member, wherein at least a portion of the plurality of elongated support members has a first end including a protrusion dimensioned and positioned to be received in a cooperating slot of the plurality of spaced slots and an adjoining support ledge and an opposed second end including a notch or groove;

further wherein each notch or groove is dimensioned to be nested atop at least a portion of a cooperating protrusion of a vertically adjacent elongated support member.

15. The shelf or storage rack assembly of claim 14, wherein each of the protrusions is further dimensioned whereby, when received in the cooperating slot, at least a portion of the protrusion extends above a top plane of the top.

16. The shelf or storage rack assembly of claim 15, wherein each of the notches or grooves are positioned to be nested atop the at least the portion of the protrusion extending above the top plane.

17. The shelf or storage rack assembly of claim 16, wherein each of the notches or grooves are further dimensioned whereby, when nested atop the portion of the protrusion, a bottom surface portion of the elongated support member adjacent to the notch or groove rests atop a top surface portion of a vertically adjacent shelf or storage rack top.

* * * * *